US008591109B2

(12) United States Patent
Ackerman et al.

(10) Patent No.: US 8,591,109 B2
(45) Date of Patent: Nov. 26, 2013

(54) STAND-UP POUCH WITH A COLLAPSIBLE BODY

(75) Inventors: Bryan L. Ackerman, Freeland, MI (US); Anne C. Moser, Chicago, IL (US); Daniel Perez, Chicago, IL (US); Abby Sturges, Stanford, CA (US)

(73) Assignee: S.C. Johnson & Son, Inc., Racine, WI (US)

( * ) Notice: Subject to any disclaimer, the term of this patent is extended or adjusted under 35 U.S.C. 154(b) by 308 days.

(21) Appl. No.: 12/566,321

(22) Filed: Sep. 24, 2009

(65) Prior Publication Data

US 2011/0069911 A1 Mar. 24, 2011

(51) Int. Cl.

| | |
|---|---|
| ***B65D 30/16*** | (2006.01) |
| ***B65D 33/00*** | (2006.01) |
| ***B65D 33/16*** | (2006.01) |
| ***B65D 30/20*** | (2006.01) |
| ***B65D 30/10*** | (2006.01) |

(52) U.S. Cl.
USPC ..... 383/64; 383/104; 383/105; 383/63; 383/120; 383/121

(58) Field of Classification Search
USPC ..... 383/64, 104, 105, 63, 120, 121
See application file for complete search history.

(56) References Cited

U.S. PATENT DOCUMENTS

| | | | | |
|---|---|---|---|---|
| 3,070,265 | A * | 12/1962 | Everett | 222/386.5 |
| 3,482,761 | A * | 12/1969 | Lindstrom et al. | 383/8 |
| 3,935,993 | A | 2/1976 | Doyen et al. | |
| 4,032,064 | A * | 6/1977 | Giggard | 222/95 |
| 4,741,789 | A | 5/1988 | Zieke et al. | |
| 4,837,849 | A | 6/1989 | Erickson et al. | |
| 4,930,644 | A * | 6/1990 | Robbins, III | 215/382 |
| 5,012,561 | A | 5/1991 | Porchia et al. | |
| 5,158,371 | A | 10/1992 | Moravek | |
| 5,788,378 | A * | 8/1998 | Thomas | 383/63 |
| 5,843,540 | A | 12/1998 | Heydarpour et al. | |
| 6,021,557 | A | 2/2000 | Dais et al. | |
| 6,095,687 | A | 8/2000 | Dematteis | |
| 6,102,568 | A * | 8/2000 | Davis | 383/43 |
| 6,139,186 | A | 10/2000 | Fraser | |
| 6,206,569 | B1 * | 3/2001 | Kraimer et al. | 383/109 |
| 6,401,759 | B1 * | 6/2002 | Kamiyama et al. | 138/98 |
| 6,533,456 | B1 | 3/2003 | Buchman | |
| 6,659,645 | B1 | 12/2003 | Schulz | |
| 6,805,485 | B2 * | 10/2004 | Hogan et al. | 383/64 |
| 6,942,100 | B2 | 9/2005 | Su | |
| 7,137,736 | B2 | 11/2006 | Pawloski et al. | |
| 7,175,583 | B2 | 2/2007 | Su | |
| 7,270,480 | B2 * | 9/2007 | Price | 383/120 |
| 7,370,788 | B1 * | 5/2008 | Otani et al. | 229/406 |

(Continued)

FOREIGN PATENT DOCUMENTS

| | | | | |
|---|---|---|---|---|
| WO | WO 2007131666 A1 * | 11/2007 | | B65D 33/02 |
| WO | WO2009100019 | 8/2009 | | |

*Primary Examiner* — Nathan J Newhouse
*Assistant Examiner* — Derek Battisti

(57) ABSTRACT

A pouch includes a body formed from a film that defines a generally flat base and an upstanding wall that extends from the base to form an elongate mouth having first and second opposing faces. The upstanding wall has a varying thickness with a first thickness of the upstanding wall at a lower portion of the body being greater than a second thickness of the upstanding wall at an upper portion of the body. The body stands independently in an upright position upon the base when the body is in an expanded position.

24 Claims, 3 Drawing Sheets

(56) References Cited

U.S. PATENT DOCUMENTS

| | | | | |
|---|---|---|---|---|
| 7,506,416 | B2 | 3/2009 | Hoffman et al. | |
| 7,524,111 | B1 * | 4/2009 | Williams | 383/104 |
| 7,574,781 | B2 | 8/2009 | Ackerman et al. | |
| 7,784,160 | B2 | 8/2010 | Dais et al. | |
| 7,886,412 | B2 | 2/2011 | Dais et al. | |
| 7,946,766 | B2 | 5/2011 | Dais et al. | |
| 2004/0066984 | A1 * | 4/2004 | Yi Li | 383/64 |
| 2006/0104547 | A1 * | 5/2006 | Matlock | 383/63 |
| 2007/0047851 | A1 * | 3/2007 | Sato et al. | 383/104 |
| 2008/0298727 | A1 * | 12/2008 | Edgington et al. | 383/105 |
| 2009/0214142 | A1 * | 8/2009 | Bossel et al. | 383/204 |

* cited by examiner

STAND-UP POUCH WITH A COLLAPSIBLE BODY

CROSS REFERENCE TO RELATED APPLICATIONS

Not applicable.

REFERENCE REGARDING FEDERALLY SPONSORED RESEARCH OR DEVELOPMENT

Not applicable.

SEQUENTIAL LISTING

Not applicable.

BACKGROUND OF THE INVENTION

1. Field of the Invention

The present disclosure relates to pouches and, more particularly, to a stand-up pouch with a collapsible body.

2. Background of the Invention

A typical pouch for the storage of items, such as food or other household items, is made of a thin film, such as thermoplastic or foil, so that the pouch is flexible enough to be collapsed into a substantially flat or folded configuration and expanded to accommodate items that are stored therein. Generally, the typical pouch is unable to stand upright by itself without some external support, such as from a user holding the pouch open. In addition, the typical pouch commonly includes heat seals along the sides and/or bottom, along which leaks or tears may be more likely to occur.

Attempts have been made in the past to modify a typical pouch such that a user does not have to hold the pouch open while trying to fill an interior thereof, in order to free up both hands of the user during the filling process. Prior attempts have focused on creating complex gusset patterns in walls of the pouch and/or to rely on using complicated multilayer wall panels, wherein the wall panels may be extruded by conventional web extrusion methods and subsequently formed and sealed along seams into the general form of a pouch.

One suggested modification to the typical pouch includes providing gusseted wall panels, such as a bottom gusset, front and back panels, and first and second gusseted side panels. The bottom gusset is expandable to provide a simple base structure upon which the pouch can stand in an upright position. The gusseted wall panels are made from a constant thickness film, wherein the sidewalls of the pouch are flexible and tend to fold over or collapse when the pouch is not filled. Further, the pouch with gusseted wall panels can include a multipart closure profile at an upper opening thereof. The multipart closure profile is a relatively complex structure that includes inwardly facing profiles on opposite inner surfaces of the front and back panels and outwardly facing profiles on adjacent outer surfaces of the first and second gusseted side panels. In order to seal the opening of the pouch, the front and back panels are folded together so that the inwardly facing profiles interlock, while each of the first and second gusseted side panels are folded generally in half, so that the outwardly facing profiles interlock.

Another suggested modification to the typical pouch is to form a pouch from a multilayer film that is heat-sealed together along side and bottom portions thereof to form a pouch with a bottom gusset. More specifically, the multilayer film must be composed of materials that are heat-sealable at different ranges of temperatures to avoid heat sealing incorrect walls together during the manufacturing process.

SUMMARY OF THE INVENTION

In one example, a pouch includes a body formed from a film that defines a generally flat base and an upstanding wall that extends from the base to form an elongate mouth having first and second opposing faces. The film has a first thickness at a lower portion of the body that is greater than a second thickness at an upper portion of the body, and the body stands independently in an upright position upon the base when in an expanded position.

In another example, a pouch includes a seamless body formed from a material to define a generally flat base and an upstanding wall that extends from the base to form an elongate mouth having first and second opposing faces. The material has a first thickness at a lower portion of the body that is greater than a second thickness at an upper portion of the body, and the body stands independently in an upright position upon the base when in an expanded position.

In a further example, a pouch includes a body having a generally flat base and an upstanding wall that extends from the base to form a mouth. An upper portion of the body is formed from a first material and a lower portion of the body is formed from a second material that is more rigid than the first material, to allow the body to stand independently in an upright position upon the base when in an expanded position.

DETAILED DESCRIPTION

Figure 1:
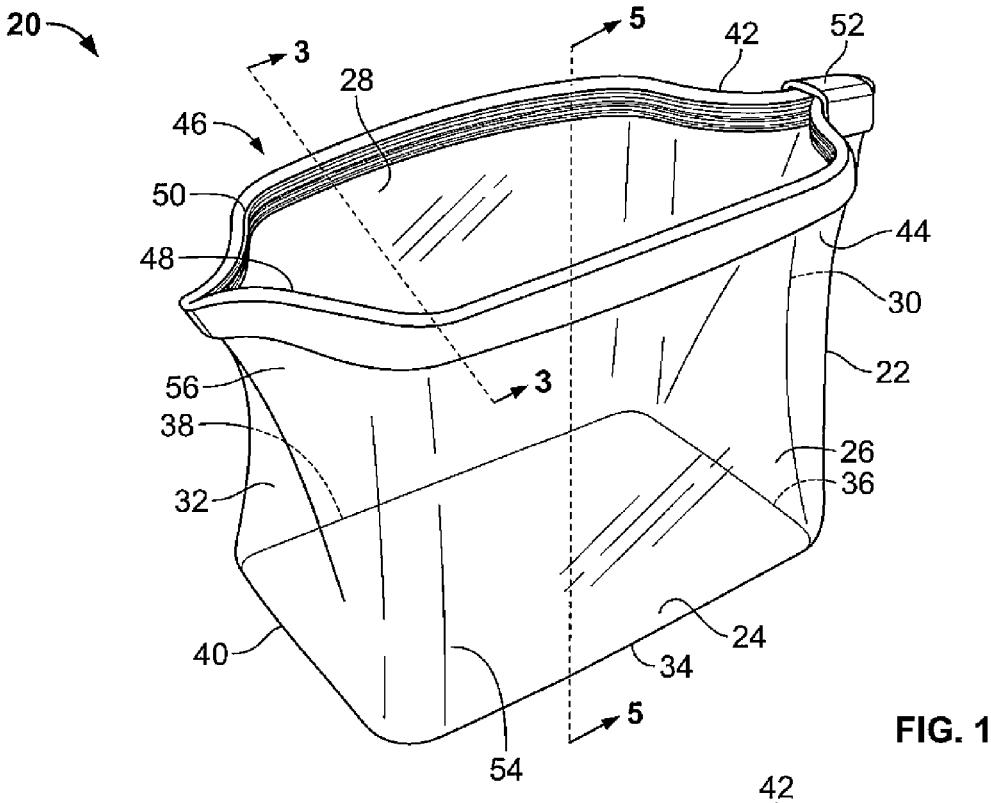
FIG. 1 is an isometric view of a pouch according to one embodiment of the disclosure, in an open condition.

A pouch is disclosed herein that is designed to stand independently in an upright position on a base portion. The pouch is sufficiently rigid to maintain its shape while it is being filled with items, yet flexible enough to be easily collapsed for storage, when not in use, or collapsed about items stored within the pouch to occupy a smaller volume when in use. In one embodiment, the pouch has a seamless body to minimize weak spots therein and to avoid the formation of leaks or tears. Additionally, the body of the pouch can be formed to define an elongate opening to facilitate the attachment of a closure mechanism thereto, such as a leak proof extruded thermoplastic interlocking closure.

In one example, a pouch includes a body formed from a film that defines a generally flat base and an upstanding wall that extends from the base to form an elongate mouth having first and second opposing faces. The film has a first thickness at a lower portion of the body that is greater than a second thickness at an upper portion of the body, so that the body can stand independently in an upright position upon the base when in an expanded position. In various examples, the thickness of the film transitions gradually from the first thickness to the second thickness or transitions in one or more steps from the first thickness to the second thickness. Further, the body can include at least one fold line about which the body is collapsible and expandable. Still further, the first thickness can be about three times the thickness of the second thickness. In another example, the flat base is a generally oval shape. In yet another example, the body is seamless and formed from a single layer thermoplastic film, wherein the first thickness can be between about 6 mils (about 0.15 mm) and about 15 mils (about 0.38 mm), and the second thickness can be between about 1 mils (about 0.025 mm) and about 5 mils (about 0.13 mm). Another aspect of the present pouch can be an elongate closure mechanism disposed adjacent to the elongate mouth, wherein the elongate closure mechanism includes a first closure profile disposed on the first face and a second closure profile disposed on the second face. The first closure profile occludes and deoccludes with the second closure profile to provide a substantially leak proof resealable closure for the pouch. Additionally, a slider can be coupled to the closure mechanism for occluding and deoccluding the closure profiles.

In another example, a pouch includes a seamless body formed from a material to define a generally flat base and an upstanding wall that extends from the base to form an elongate mouth having first and second opposing faces. The material has a first thickness at a lower portion of the body that is greater than a second thickness at an upper portion of the body, so that the body can stand independently in an upright position upon the base when in an expanded position. The material can be a single layer thermoplastic film. Further, the thickness of the material can transition gradually from the first thickness to the second thickness or can transition in one or more steps from the first thickness to the second thickness. Additionally, the pouch can include a plurality of hinges in the body about which the body is collapsible and expandable. Still further, the pouch may include an elongate closure mechanism disposed adjacent to the elongate mouth, and a slider coupled to the closure mechanism for occluding and deoccluding the closure mechanism. The single elongate closure mechanism includes a first closure profile disposed on the first face and a second closure profile disposed on the second face. The first closure profile occludes and deoccludes with the second closure profile to provide a substantially leak proof resealable closure for the pouch.

In yet another example, a pouch includes a body having a generally flat base and an upstanding wall that extends from the base to form a mouth. An upper portion of the body is formed from a first material and a lower portion of the body is formed from a second material that is more rigid than the first material, to allow the body to stand independently in an upright position upon the base when in an expanded position. In various examples of the present example, the pouch is seamless and formed from a single layer film. Further, the first material can have a thickness that is lesser than the thickness of the second material. Still further, the body can include at least one fold line about which the body is collapsible.

Figure 2:
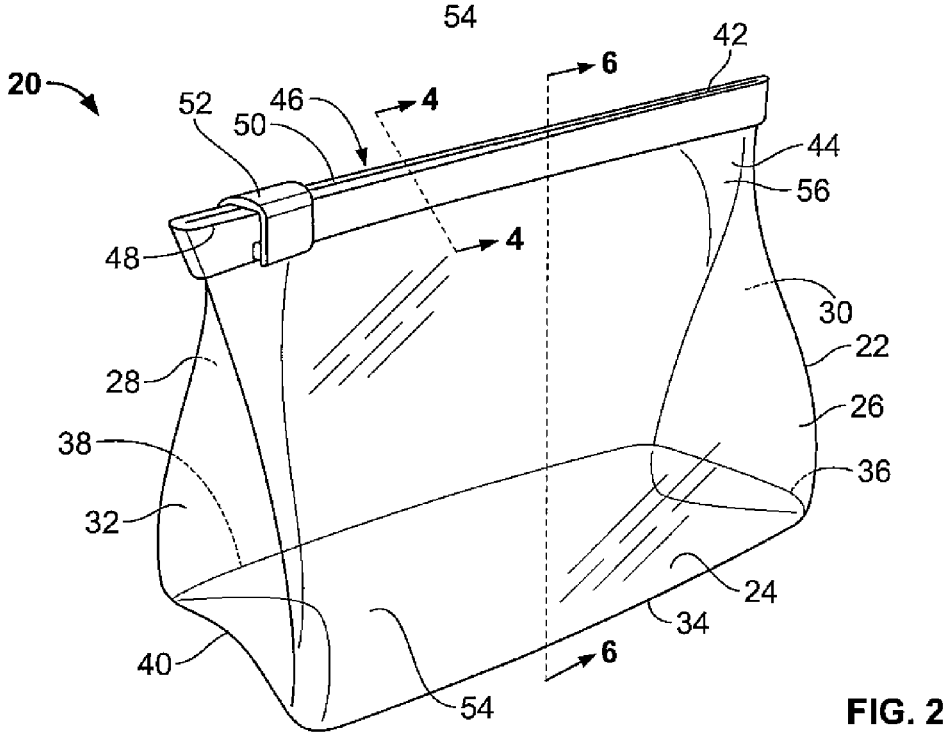
FIG. 2 is an isometric view of the pouch of FIG. 1 in a closed condition.

Referring now to FIGS. 1 and 2, a pouch 20 includes a pouch body 22 that is generally defined by a base portion 24, first and second opposing walls 26, 28, respectively, and first and second gusseted end walls 30, 32, respectively. In the present embodiment, the base portion 24 is substantially flat and planar, to provide a stable base, upon which the pouch 20 can stand upright. Further, the base portion 24 in the present embodiment has a generally rectangular shape with first, second, third, and fourth sides 34, 36, 38, 40, respectively. However, in other embodiments, the base portion 24 can be other shapes, such as oval, triangular, or trapezoidal, or other shapes that would be apparent to one of ordinary skill in the art. The first and second walls 26, 28 extend upwardly from opposite first and third sides 34, 38, respectively, of the rectangular base portion 24 and the first and second end walls 30, 32 extend upwardly from opposite second and fourth sides 36, 40, respectively, of the rectangular base portion. Further, the first and second walls 26, 28 are connected to each other via the first and second end walls 30, 32 to form the pouch body 22 and to further define an opening 42 therebetween at a top portion 44 of the pouch 20.

In one embodiment, the opening 42 has a substantially straight configuration that is suitable for the operation placement of a closure mechanism 46 thereto. In the present embodiment, the closure mechanism 46 includes first and second closure profiles 48, 50, respectively, disposed along the top portion 44 of the pouch 20 in such a manner to enable the opening 42 to be resealably closed. Each closure profile 48, 50 may be disposed on a respective internal side or surface of the first and second walls 26, 28 and first and second gusseted end walls 30, 32. The first and second closure profiles 48, 50 releasably occlude or seal with each other to open and to close the opening 42. Further, a slider 52 is operatively coupled to the first and second closure profiles 48, 50 to facilitate selective opening and closing thereof.

The pouch 20, according to one embodiment, is formed of a thermoplastic, such as low density polyethylene (LDPE), high density polyethylene (HDPE), linear low density polyethylene (LLDPE), polypropylene, nylon, or other heat moldable polymeric material. In other embodiments, the pouch 20 is made of organic or biodegradable polymers, such as polyesters based on lactic acid. Further, different portions of the pouch 20 may be formed from the same or different materials or combinations of such materials. For example, the closure profiles 48, 50 and a lower portion 54 of the body 22 that includes the base portion 24 and a lower portion of each of the walls 26-32 can be formed of a mixture HDPE, LDPE, and LLDPE to be more rigid than an upper portion 56 of the body 22 that is formed of LDPE to be more flexile and supple. In this embodiment, the more rigid lower portion 54 provides a stable base upon which the pouch 20 can stand upright without the need for additional support, for instance, from a user holding the pouch open and upright, or from a bowl or frame within which the pouch is positioned. The more flexible upper portion 56 provides an opening that can be easily opened and closed by a user. Further, in one embodiment, the pouch body is formed from a single layer of polyethylene and is seamless, to provide a leak-resistant pouch that is suitable to store food products and liquids.

While flexible and rigid can be relative terms, in one context, flexible can be considered in relation to the flexibility of a thermoplastic pouch that is easily deformable by an average human user and rigid can be considered in relation to the rigidity of a thermoplastic container that maintains its shape while it is being filled with items, such as solid or liquid food products, at about standard room temperature and atmospheric pressure. For example, a flexible thermplastic pouch can be a Ziploc® brand freezer bag or sandwich bag manufactured by S.C. Johnson and Son, Inc. of Racine, Wis. ("S.C. Johnson"), and a rigid thermoplastic container can be a Ziploc® brand container similarly manufactured by S.C. Johnson. However, the concepts disclosed herein would be equally applicable to many others applications outside of such home storage products, as would be apparent to one skilled in the art.

Figure 3:
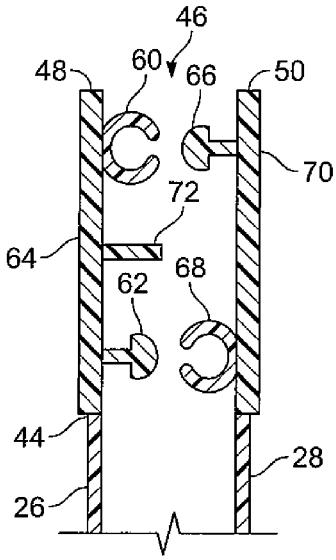
FIG. 3 is a cross-sectional view of a closure mechanism according to one embodiment taken along lines 3-3 of FIG. 1 in a deoccluded position.
Figure 4:
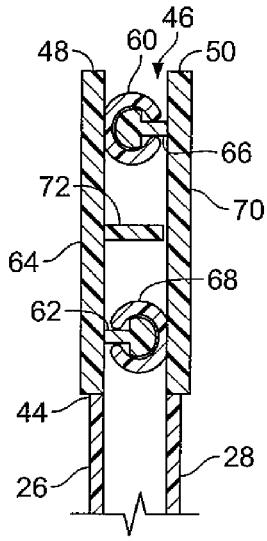
FIG. 4 is a cross-sectional view of the closure mechanism of FIG. 3 taken along lines 4-4 of FIG. 2 in an occluded position.

Referring now to FIGS. 3 and 4, in one embodiment, the first closure profile 48 includes a first closure element 60 and a second closure element 62 protruding from a first backing member 64, and the second closure profile 50 includes a third closure element 66 and a fourth closure element 68 protruding from an opposing second backing member 70. Together, the closure profiles 48, 50 are often referred to as a double zipper. In one embodiment, the backing members 64, 70 are connected to the top portion 44 of the pouch 20, and in another embodiment, the backing members 64, 70 are simply extensions of or part of the pouch. Other connection arrangements are also possible and contemplated as possible embodiments. An elongate ridge or rib 72 extends substantially along the length of the first closure profile 48. The rib 72 protrudes from the backing member 64 spaced between the first and second closure elements 60, 62. When the closure profiles 48, 560 are in an occluded or sealed configuration (shown in FIG. 4), opposing closure elements 60 and 66 (e.g., upper closure elements) and opening closure elements 62, 68 (e.g., lower closure elements) interlock, and the rib 74 extends substantially between the first backing member 64 and the second backing member 70, to form a secure seal therebetween. In another embodiment, the rib 74 may extend substantially along the length of the second closure profile 50. Other modifications can be made to the closure mechanism 46 as would be apparent to one of ordinary skill in the art.

In the embodiment of FIGS. 3 and 4, the first and fourth closure elements 60, 68 have female C-shaped interlocking profiles, and the second and third closure elements 62, 66 have male arrow-shaped interlocking profiles, wherein the profiles extend substantially or completely along the length of the respective closure profiles 48, 50. However, the specific shape and configuration of the individual closure elements and the rib can be altered without departing from the spirit of the invention. In another embodiment, for example, the closure profiles 48, 50 may include additional closure elements in order to create a more secure and leak resistant seal and/or may contain both female elements on one backing member and corresponding male elements on the opposing backing member. Examples of some other closure elements suitable for use with the pouch 20 may be found in Zieke et al. U.S. Pat. No. 4,741,789, Porchia et al. U.S. Pat. No. 5,012,561, Dais et al. U.S. Pat. No. 6,021,557, and/or Pawloski et al. U.S. Pat. No. 7,137,736, each of which is incorporated by reference herein in its entirety. Other interlocking profiles useful in the present disclosure include those disclosed in, for example, Dais et al. U.S. patent application Ser. No. 11/725,120, filed Mar. 16, 2007, now U.S. Pat. No. 7,886,412, and Dais et al. U.S. patent application Ser. No. 11/818,586, now U.S. Pat. No. 7,946,766, and Ser. No. 11/818,593, now U.S. Pat. No. 7,784,160, each filed on Jun. 15, 2007, each of which is incorporated by reference herein in its entirety. Still further, other closure mechanisms may be utilized with any of the embodiments disclosed herein or the closure mechanism may be omitted entirely.

The slider 52 (see, e.g., FIGS. 1 and 2) may be any suitable slider known to one of ordinary skill in the art that will occlude the closure profiles 48, 50 when moved or slid along the opening 42 of the pouch 20 in a first direction and deocclude the closure profiles 48, 50 when moved or slid along the opening 42 of the pouch 20 in a second opposite direction. In one example, a suitable slider 52 includes walls at a first end that press together and occlude the closure profiles 48, 50 and a separator finger that extends between the closure profiles to separate and to deocclude the closure profiles. Other examples of suitable sliders are disclosed in Hoffman U.S. Pat. No. 7,506,416 and Ackerman et al. U.S. Pat. No. 7,574,781, each of which is incorporated by reference herein in its entirety. Other slider designs may be used as appropriate for different closure mechanisms.

Figure 5:
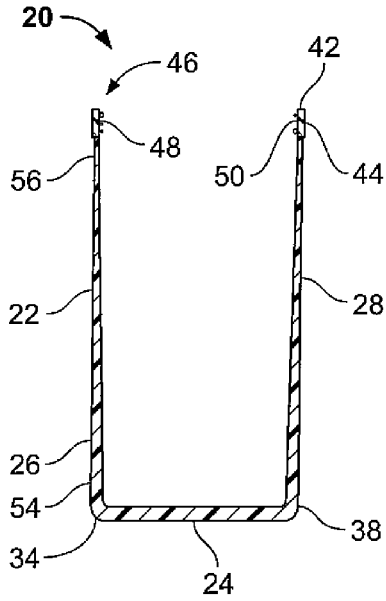
FIG. 5 is a cross-sectional view of the pouch of FIG. 1 taken along lines 5-5.
Figure 6:
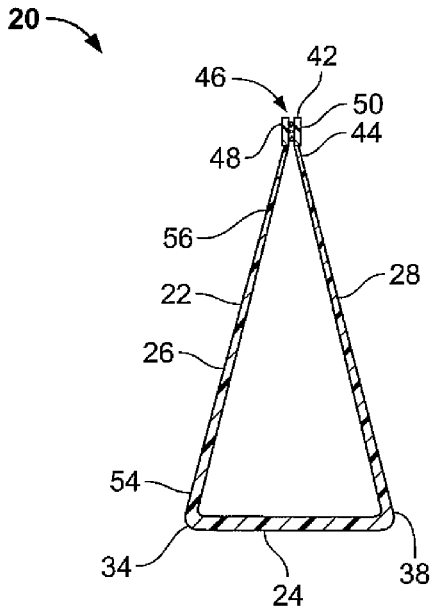
FIG. 6 is a cross-sectional view of the pouch of FIG. 2 taken along lines 6-6.
Figure 7:
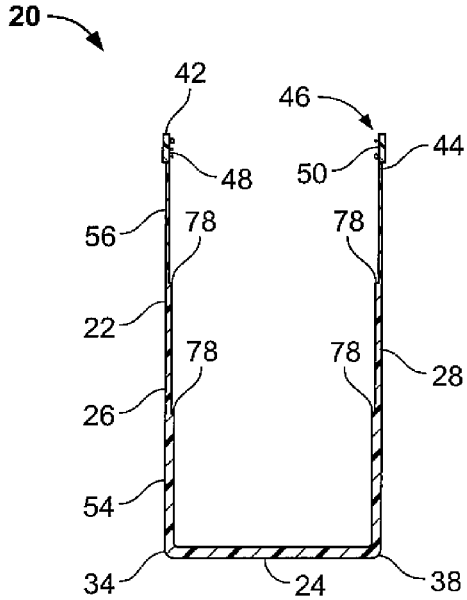
FIG. 7 is a cross-sectional view, similar to that of FIG. 5, of a further embodiment of a pouch according to the present disclosure.

FIGS. 5, 6 and 7 illustrate further embodiments of the pouch 20, wherein the lower portion 54 of the pouch has a greater thickness than the upper portion 56 of the pouch such that the greater thickness of the lower portion 54 gives the pouch 20 resiliency to stand upright upon the base portion 24, while the lesser thickness of the upper portion 56 gives the pouch greater flexibility so that the opening 42 of the pouch can be more easily opened and closed by a user. In the embodiments of FIGS. 5-7, the upper and lower portions 54, 56 of the pouch 20 are still sufficiently thin and flexible to allow the pouch to readily fold or to collapse when not in use. More specifically, the thicker lower portion 54 of the pouch 20 provides a sufficient amount of plastic deformability or resiliency so as to be able to stand upright under its own weight, while still being easily plastically deformable by a user to collapse into a flattened or a reduced volume state. In one embodiment, the lower portion 54 of the pouch has a thickness between about 6 mils (about 0.15 mm) and about 15 mils (about 0.38 mm), and the upper portion 56 of the pouch has a thickness between about 1 mils (about 0.025 mm) and about 5 mils (about 0.13 mm). In another embodiment, the lower portion 54 of the pouch has a thickness about 8 mils (about 0.20 mm) and about 10 mils (about 0.25 mm) and the upper portion 56 of the pouch has a thickness between about 2 mils (about 0.051 mm) and about 4 mils (about 0.10 mm). To provide some context, a typical thermoplastic pouch used to store food products has a thickness of about 2.7 mils (about 0.069 mm). Therefore, in one embodiment, the lower portion 54 of the pouch 20 has a thickness between about three and about four times the thickness of a typical thermoplastic pouch and the upper portion 56 of the pouch can have a thickness that is approximately equal to the thickness of a typical thermoplastic pouch. Consequently, the lower portion 54 of the pouch 20 provides a more rigid base for the pouch to stand upright upon, the upper portion 56 of the pouch provides a flexible top portion 44 upon which the closure profiles 34, 36 can be operationally placed, and the entire pouch 20 is flexible enough to collapse for storage when not in use.

In FIGS. 5 and 6, the thickness of the pouch 20 gradually and continuously increases from a greatest thickness at the base portion 24 of the pouch 20 to a least thickness at the top portion 44 of the pouch. In other embodiments, the thickness of pouch 20 varies in one or more stepped portions 78 of different thicknesses, as shown in FIG. 7. In one example, the thicker lower portion 54 includes the base portion 24 and about a lower one-third to two-thirds of each wall 26-32, and the thinner upper portion 56 includes about an upper two-thirds to one-third of each wall 26-32.

Figure 8:
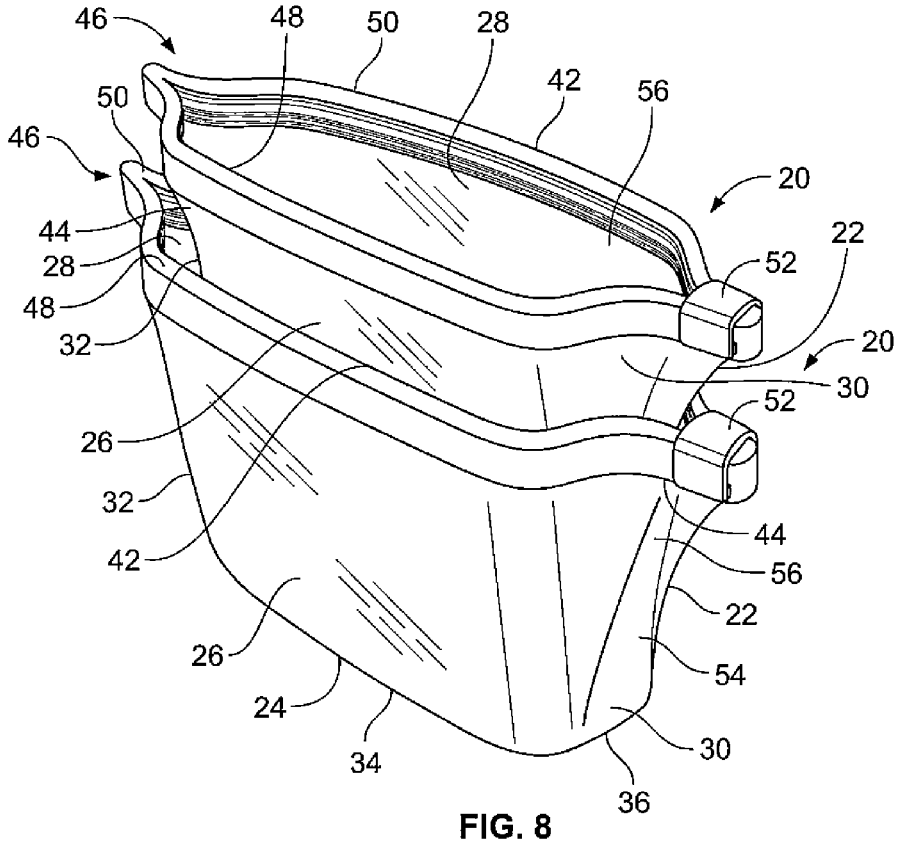
FIG. 8 is an isometric view of the pouch of FIG. 1 in a nested condition within a similar second pouch.
Figure 9:
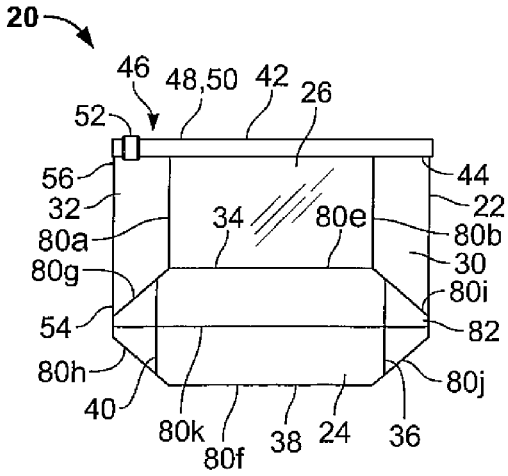
FIG. 9 is a front side elevational view of a pouch in a folded condition, according to another embodiment.
Figure 10:
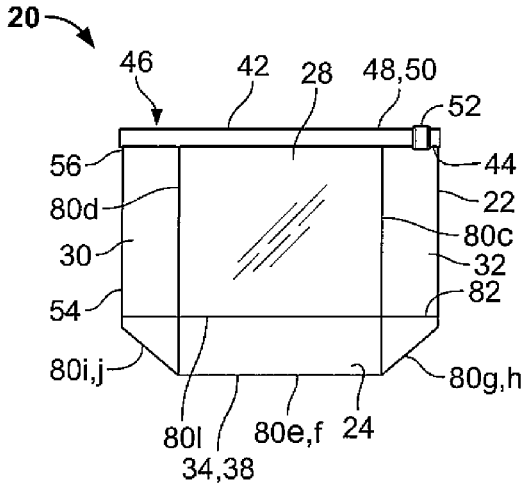
FIG. 10 is a back side elevational view of a pouch in a folded condition according to yet another embodiment.

Referring now to FIGS. 8, 9, and 10, the pouch 20 of any of the embodiments disclosed herein can be flexible, so that a user can manipulate one pouch 20 to be nested within another, as shown, for example, in FIG. 8, or so that the user can fold the pouch 20 into a substantially flat condition, as shown in FIGS. 9 and 10, to reduce storage space when the pouches are not in use. In FIGS. 9 and 10, the pouch 20 includes one or more fold lines or hinges **80*a*-80*l* that facilitate the expansion of the pouch into an open condition that is capable of standing upright upon the base portion 24, similar to that shown in FIGS. 1 and 2, and folding of the pouch into the substantially flat condition of FIGS. 9 and 10. For example, the first and second walls 26, 28 and the first and second gusseted end walls 30, 32 are joined to each other and to the bottom panel 24 along a plurality of hinges 80***a*-80*j* (hinges 80*c* and 80*d* seen more clearly in FIG. 10). In the present embodiment, the hinge 80*k* is disposed longitudinally across the base portion 24 and generally separates the base portion 24 into two halves. Further, as seen in FIG. 10, the hinge 80*l* is disposed longitudinally at a lower portion 82 of one or both of the walls 26, 28 to facilitate folding of the base portion 24 against one or the other of the walls 26, 28 when the pouch 20 is folded into the substantially flat condition. In one embodiment, one or more of the hinges 80*a*-80*j* are integrally molded hinges, such as living hinges formed from narrow elongate sections having a thinner thickness than the rest of or surrounding portions of the pouch body 22. In other embodiments, the fold lines and hinges 80*a*-80*l* can be formed using known techniques, and other arrangements of fold lines and hinges can be used as would be apparent to one of ordinary skill in the art.

The pouches 20 disclosed herein can be formed by any appropriate known method, such as on a production line that utilizes a web of thermoplastic material that is formed into the pouch through known cutting, heat sealing, and extrusion techniques. For example, a multi-thickness, single layered web of thermoplastic material may be extruded, folded, heat sealed, and cut to form the pouch of FIGS. 5-7. In another example, a single or multi-thickness web of different materials or combinations of materials may be extruded, folded, heat sealed, and cut to form a pouch 20 that has a more rigid lower portion 54 and a more flexible upper portion 56, as described hereinabove. In another embodiment, the pouch 20 may be formed by injection molding techniques. In yet another embodiment, one or more portions of the pouch 20, such as the lower portion 54, are formed by injection molding techniques, and other portions of the pouch, such as the upper portion 56 and the closure mechanism 46, are attached using heat seals, adhesive, and/or extrusion techniques. Such injection molding techniques can be used to form a pouch 20 that minimizes the amount of seams or that is seamless, which may cause the finished pouch to be leak proof. In a further embodiment, the pouch 20 is formed from a preform, such as a blank of smaller size that has the same general shape or form as that of the final pouch, using blow molding or vacuum molding techniques, and the closure mechanism 46 is attached using known techniques, such as with heat seals, adhesives, or extrusion. In this embodiment, the preform can be seamless, so that the finished pouch 20 is also seamless and leak proof.

Other embodiments of the disclosure, including all the possible different and various combinations of the individual features of each of the foregoing described embodiments, are specifically included herein.

INDUSTRIAL APPLICABILITY

The present disclosure discloses various pouches that may be collapsible and are able to remain open on their own, without necessitating the use of a user's hands while trying to fill the pouch. The collapsible pouches disclosed herein, in some embodiments, overcome issues related to forming gusseted wall panels and/or complicated multilayer wall panels.

Numerous modifications to the present disclosure will be apparent to those skilled in the art in view of the foregoing description. Accordingly, this description is to be construed as illustrative only and is presented for the purpose of enabling those skilled in the art to make and to use the invention and to teach the best mode of carrying out the same. The exclusive right to all modifications within the scope of this disclosure is reserved.

We claim:

1. A pouch comprising:

(A) a seamless body having:

(a) a first end and a second end, the second end of the body being on an opposite end from the first end of the body;

(b) a substantially flat, planar base at the first end of the body; and (c) first and second opposing walls that extend upwardly from the planar base to form an elongate mouth at the second end of the body, the first and second opposing walls each comprising an upper wall portion and a lower wall portion, the upper wall portions of each of the first and second opposing walls extending to the elongate mouth and including a flexible wall portion, the lower wall portions of each of the first and second opposing walls extending to the planar base; and (B) an elongate closure mechanism being disposed on the flexible wall portions and adjacent to the elongate mouth, the elongate closure mechanism providing a resealable closure for the pouch, wherein the first and second opposing walls of the seamless body have a varying thickness, with (i) the planar base and the lower wall portions of each of the first and second opposing walls having a first thickness, (ii) the upper wall portions of each of the first and second opposing walls having a second thickness, and (iii) the flexible wall portions having a third thickness, the first thickness being greater than the second thickness, and the second thickness being greater than the third thickness, wherein the seamless body stands independently in an upright position upon the planar base when the body is in an expanded position, and wherein the pouch is both flexible and collapsible, such that the pouch can be folded into a substantially flat condition.

2. The pouch of claim 1, wherein the thickness of each of the first and second opposing walls of the seamless body transitions gradually from the first thickness to the second thickness.

3. The pouch of claim 2, wherein the thickness of each of the first and second opposing walls of the seamless body transitions gradually from the second thickness to the third thickness.

4. The pouch of claim 1, wherein the thickness of each of the first and second opposing walls of the seamless body transitions in at least one step from the first thickness to the second thickness.

5. The pouch of claim 4, wherein the thickness of each of the first and second opposing walls of the seamless body transitions in at least one step from the second thickness to the third thickness.

6. The pouch of claim 1, wherein the seamless body includes at least one fold line about which the body is collapsible and expandable.

7. The pouch of claim 1, wherein the first thickness is about three times the thickness of the second thickness.

8. The pouch of claim 1, wherein the substantially flat, planar base has a generally oval shape.

9. The pouch of claim 1, wherein the elongate mouth has first and second opposing faces on the first and second opposing walls, and the elongate closure mechanism includes a first closure profile disposed on the first face and a second closure profile disposed on the second face, and wherein the first closure profile occludes and deoccludes with the second closure profile to provide a substantially leak proof resealable closure for the pouch.

10. The pouch of claim 9, further comprising a slider coupled to the closure mechanism for occluding and deoccluding the closure profiles.

11. The pouch of claim 1, wherein the seamless body has an upper portion that is formed from a first material and a lower portion that is formed from a second material that is more rigid than the first material, to allow the body to stand independently in the upright position upon the substantially flat, planar base, when the body is in the expanded position.

12. The pouch of claim 11, wherein the pouch is formed from a single layer.

13. The pouch of claim 11, wherein the first material has a thickness that is less than the thickness of the second material.

14. The pouch of claim 11, further comprising at least one fold line about which the seamless body is collapsible.

15. The pouch of claim 1, wherein the seamless body is formed from a film.

16. The pouch of the claim 15, wherein the seamless body is formed from a single layer thermoplastic film.

17. The pouch of claim 16, wherein the first thickness is between about six mils and about fifteen mils and the second thickness is between about one mil and about five mils.

18. The pouch of claim 15, wherein the thickness of the film transitions gradually from the first thickness to the second thickness.

19. The pouch of claim 18, wherein the thickness of the film transitions gradually from the second thickness to the third thickness.

20. The pouch of claim 15, wherein the thickness of the film transitions in at least one step from the first thickness to the second thickness.

21. The pouch of claim 20, wherein the thickness of the film transitions in at least one step from the second thickness to the third thickness.

22. The pouch of claim 15, wherein the seamless body further comprises a plurality of hinges, about which the body is collapsible and expandable.

23. The pouch of claim 15, wherein the elongate mouth has first and second opposing faces on the first and second opposing walls, and the elongate closure mechanism includes a first closure profile disposed on the first face and a second closure profile disposed on the second face, and wherein the first closure profile occludes and deoccludes with the second closure profile to provide a substantially leak proof resealable closure for the pouch.

24. The pouch of claim 23, further comprising a slider coupled to the closure mechanism for occluding and deoccluding the closure profiles.

* * * * *